US006794953B2

(12) United States Patent
Brandt

(10) Patent No.: US 6,794,953 B2
(45) Date of Patent: Sep. 21, 2004

(54) RADIO FREQUENCY AMPLIFYING CIRCUIT

(75) Inventor: Per-Olof Brandt, Lomma (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/994,844

(22) Filed: Nov. 28, 2001

(65) Prior Publication Data

US 2002/0063596 A1 May 30, 2002

Related U.S. Application Data

(60) Provisional application No. 60/253,752, filed on Nov. 29, 2000.

(30) Foreign Application Priority Data

Nov. 28, 2000 (EP) ..... 00610120

(51) Int. Cl.[7] ..... H01P 3/08
(52) U.S. Cl. ..... 333/116; 330/53
(58) Field of Search ..... 333/116, 117; 330/53, 54, 149, 254, 261, 298, 124 R

(56) References Cited

U.S. PATENT DOCUMENTS 3,911,372 A * 10/1975 Seidel ..... 330/286
4,305,043 A * 12/1981 Ho et al. ..... 330/53
4,419,635 A 12/1983 Reindel
4,656,434 A 4/1987 Selin
4,827,270 A * 5/1989 Udagawa et al. ..... 343/853
5,159,298 A * 10/1992 Dydyk ..... 333/112
5,382,925 A * 1/1995 Hayashi et al. ..... 333/112
5,499,001 A * 3/1996 Degun et al. ..... 333/115
5,917,860 A * 6/1999 Lee ..... 375/295
5,949,297 A * 9/1999 Nishida ..... 332/164
6,018,279 A * 1/2000 Arthur ..... 333/116
6,058,144 A 5/2000 Brown
6,078,227 A * 6/2000 Buer et al. ..... 333/117
6,304,155 B1 * 10/2001 Fries ..... 333/117

FOREIGN PATENT DOCUMENTS

EP 0286390 A2 10/1988

* cited by examiner

*Primary Examiner*—Michael Tokar
*Assistant Examiner*—Linh V Nguyen
(74) *Attorney, Agent, or Firm*—Burns, Doane, Swecker & Mathis, L.L.P.

(57) ABSTRACT

A hybrid coupler (66, 67; 72, 73) has four ports and is capable of coupling radio frequency signals having a certain frequency from at least one port to at least one other port. The hybrid coupler (66, 67; 72, 73) is implemented as a differential coupler arranged to couple differential radio frequency signals. With such a hybrid coupler a power amplifying circuit can be produced which has sufficiently low ripple on the supply voltage to be integrated together with more sensitive radio circuits, and which is also insensitive to load mismatch such that an isolator can be avoided. A differential hybrid coupler allows the output current to be shared between four transistors or amplifiers, thus reducing the amplitude of the ripple. Further, the frequency of the ripple is four times the operating frequency of the circuit, which makes it much easier to filter out the ripple.

17 Claims, 8 Drawing Sheets

RADIO FREQUENCY AMPLIFYING CIRCUIT

This application claims priority under 35 U.S.C. §§119 and/or 365 to 00610120-8 filed in Europe on Nov. 28, 2000 and to 60/253,752 filed in the United States of America on Nov. 29, 2000; the entire content of which is hereby incorporated by reference.

TECHNICAL FIELD OF THE INVENTION

The invention relates to a hybrid coupler having four ports and capable of coupling radio frequency signals having of a certain frequency from at least one port to at least one other port. The invention further relates to an amplifying circuit comprising such hybrid couplers, and a portable radio communications device comprising such an amplifying circuit. The invention also relates to a method of amplifying radio frequency signals.

DESCRIPTION OF RELATED ART

Radio transmitters as they are used in e.g. portable radio communications devices often have a power amplifier (PA) separated from the rest of the radio circuit, and the power amplifier is often connected to an antenna through an isolator which is provided to compensate for an impedance mismatch by the output load (i.e. the antenna) presented to the output of the power amplifier. Without the isolator the mismatch would result in an unsatisfactory value of the VSWR (Voltage Standing Wave Ratio).

Especially in portable devices there is a demand for miniaturization of the circuits, and one way of obtaining this would be to integrate the power amplifier on the same chip as the rest of the radio circuit and/or to avoid the isolator.

However, the integration of the power amplifier together with the more sensitive parts of the radio circuit will typically result in increased distortion because the power amplifier produces ripple on the supply voltage to the more sensitive circuits. In addition, this problem increases because of the tendency to use lower and lower supply voltages in such circuits. Unchanged output power from a lower voltage means a higher current and thus higher ripple on the supply voltage.

The ripple can be reduced by combining multiple transistors or other types of amplifiers in the power amplifier, provided the transistors/amplifiers are not conducting in phase. One state of the art solution is to use a differential amplifier. In this solution the current through the transistors from the supply voltage to ground is close to being constant as long as the amplifier is running in its linear region. However, such power amplifiers are generally driven so strongly that overloading occurs, i.e. they are run in their non linear region in which ripple (pulses) is still produced on the supply voltage. The benefit of the differential amplifier compared to a one-transistor amplifier is that the amplitude of the ripple is halved and the frequency is doubled, but the result is still not acceptable.

Regarding the removal of the isolator, the power amplifier can be re-biased to keep it in its linear range even with the load mismatch, but this prevents the amplifiers from being driven sufficiently strongly, and it also requires a relatively complicated regulating circuit.

Another solution utilizing the combination of multiple transistors is to use amplifying circuits with hybrid couplers. Such amplifiers are known to be less sensitive to output load mismatch, or at least they can be modified to be so. An example of this is disclosed in U.S. Pat. No. 4,656,434. Thus the isolator can be avoided. In this type of amplifier there is a 90° phase shift between the conducting periods of the two transistors. Similar to the differential amplifier the amplitude of the ripple on the supply voltage is substantially halved. There will typically be frequency components of the operating frequency and of twice the operating frequency. Again, this is an improvement compared to the one-transistor amplifier, but it is still not sufficient.

Therefore, it is an object of the invention to provide a hybrid coupler allowing an amplifying circuit to be produced which has sufficiently low ripple on the supply voltage to be integrated together with more sensitive radio circuits, and which is also insensitive to load mismatch such that an isolator can be avoided.

SUMMARY

According to the invention the object is achieved in that the hybrid coupler is implemented as a differential coupler arranged to couple differential radio frequency signals.

A differential hybrid coupler allows the output current to be shared between four transistors or amplifiers, thus reducing the amplitude of the ripple to a much lower level than that of the one-transistor amplifier. Further, the conducting periods of the four transistors are equally spaced with a 90° phase shift between them, and thus the frequency of the ripple is four times the operating frequency of the circuit, which makes it much easier to filter out the ripple in other parts of the circuit.

In one embodiment of the invention the hybrid coupler is implemented in a stripline technology, and in another embodiment it is implemented in a microstrip technology. Thus the hybrids can easily be integrated together with other circuits in one of these technologies.

In an expedient embodiment the hybrid coupler is a 3 dB coupler, such that power of the frequency supplied to one port is split substantially equally between two other ports, while the remaining port is substantially isolated from the other ports. In this way it is ensured that the output current is shared equally between the four transistors or amplifiers so that the amplitude of the ripple is reduced to one quarter of that of the one-transistor amplifier.

The hybrid coupler may be arranged to split the power between the two other ports in such a way that the signals provided at these ports are in phase with each other. This allows a simple type of hybrid to be used, but the electrical lengths of the connections between the outputs of the hybrid at the input side of the amplifying circuit and the two amplifiers must differ by a quarter of a wavelength for the signals of the operating frequency in order to ensure that the two amplifiers still conduct with a phase shift of 90° between them.

Alternatively, the hybrid coupler may be arranged to split the power between the two other ports in such a way that the signals provided at these ports are in quadrature to each other. This allows connections with equal electrical lengths to be used from the outputs to the amplifiers, because the output signals already have a 90° phase difference. In an expedient embodiment this hybrid coupler is a line coupled hybrid.

As mentioned, the invention further relates to an amplifying circuit for radio frequency signals having a certain frequency and thus a certain wavelength. This circuit comprises at least a first hybrid coupler having an input port to which radio frequency signals can be applied, an isolated port, a first output port, and a second output port, and being arranged for dividing a signal applied to the input port into a first signal component to the first output port and a second signal component to the second output port; a first amplifier having an input port and an output port, said input port being connected to the first output port of the first hybrid coupler; a second amplifier having an input port and an output port, said input port being connected to the second output port of the first hybrid coupler; and a second hybrid coupler having a first input port connected to the output port of the first amplifier, a second input port connected to the output port of the second amplifier, an isolated port, and an output port connectable to an output load impedance, and being arranged for combining signals applied to the first input port and the second input port to the output port, said first and second hybrid couplers and said first and second amplifiers providing a first and a second path for radio frequency signals from the input port of the first hybrid coupler to the output port of the second hybrid coupler, said first path comprising the first amplifier and said second path comprising the second amplifier; and wherein the total electrical lengths of the two paths are substantially identical, and the electrical length from the input port of the first hybrid coupler to each of the input ports of the first and second amplifiers differs by a quarter of a wavelength for said radio frequency signals.

When the hybrid couplers are implemented as differential couplers arranged to couple differential radio frequency signals, and the amplifiers are differential amplifiers, an amplifying circuit is provided which has sufficiently low ripple on the supply voltage to be integrated together with more sensitive radio circuits, and which is also insensitive to load mismatch such that an isolator can be avoided.

A differential hybrid coupler allows the output current to be shared between four transistors or amplifiers, thus reducing the amplitude of the ripple to a much lower level than that of a one-transistor amplifier. Further, the conducting periods of the four transistors are equally spaced with a 90° phase shift between them, and thus the frequency of the ripple is four times the operating frequency of the circuit, which makes it much easier to filter out the ripple in other parts of the circuit.

In one embodiment of the invention the first and second hybrid couplers are implemented in a stripline technology, and in another embodiment they are implemented in a microstrip technology. Thus the hybrids and the amplifying circuit can easily be integrated together with other circuits in one of these technologies.

In an expedient embodiment the first and second hybrid couplers are 3 dB couplers. In this way it is ensured that the output current is shared equally between the four transistors or amplifiers so that the amplitude of the ripple is reduced to one quarter of that of the one-transistor amplifier.

The first and second hybrid couplers may be in-phase couplers, such that said first and second signal components on the output ports of the first hybrid coupler are in phase with each other, and signals in phase with each other applied to the two input ports of the second hybrid coupler are combined to one signal at its output port. This allows a simple type of hybrid to be used, but the electrical lengths of the connections between the outputs of the hybrid at the input side of the amplifying circuit and the two amplifiers, and those between the two amplifiers and the inputs of the hybrid at the output side of the amplifying circuit, must differ by a quarter of a wavelength for the signals of the operating frequency in order to ensure that the two amplifiers still conduct with a phase shift of 90° between them.

Alternatively, the first and second hybrid couplers may be quadrature couplers, such that the first and second signal components on the output ports of the first hybrid coupler are in quadrature to each other, and signals in quadrature to each other applied to the two input ports of the second hybrid coupler are combined to one signal at its output port.

This allows connections with equal electrical lengths to be used from the outputs of the hybrid at the input side of the amplifying circuit to the amplifiers, and from the amplifiers to the inputs of the hybrid at the output side of the amplifying circuit, because the output signals already have a 90° phase difference. In an expedient embodiment the first and second hybrid couplers are line-coupled hybrids.

As mentioned, the invention further relates to a portable radio communications device comprising an amplifying circuit as described above. Due to the above-mentioned advantages such a device can be further miniaturized, because the power amplifier can be integrated together with other parts of the radio circuit, and the isolator may be avoided. In an expedient embodiment the device is a mobile telephone.

As mentioned, the invention further relates to a method of amplifying radio frequency signals having a certain frequency and thus a certain wavelength. The method comprises the steps of applying radio frequency signals to an input port of a first hybrid coupler; dividing the signals applied to the input port into a first signal component to a first output port of the first hybrid coupler and a second signal component to a second output port of the first hybrid coupler; amplifying said first signal component in a first amplifier having an input port and an output port, said input port being connected to the first output port of the first hybrid coupler; amplifying said second signal component in a second amplifier having an input port and an output port, said input port being connected to the second output port of the first hybrid coupler; coupling the amplified first signal component from the output port of the first amplifier to a first input port of a second hybrid coupler and the amplified second signal component from the output port of the second amplifier to a first input port of the second hybrid coupler; combining in the second hybrid coupler the signals applied to the input ports thereof to an output signal on the output port of the second hybrid coupler; and coupling said output signal to an output load impedance; wherein the total electrical lengths of the paths of the two signal components from the input port of the first hybrid coupler to the output port of the second hybrid coupler are substantially identical, and the electrical length from the input port of the first hybrid coupler to each of the input ports of the first and second amplifiers differs by a quarter of a wavelength for said radio frequency signals.

When the radio frequency signals are applied, coupled and amplified as differential signals from the input port of the first hybrid coupler to the output port of the second hybrid coupler, an amplifying method is provided which has sufficiently low ripple on the supply voltage to allow a corresponding circuit to be integrated together with more sensitive radio circuits, and which is also insensitive to load mismatch such that an isolator can be avoided.

Differential amplification allows the output current to be shared between four transistors or amplifiers, thus reducing the amplitude of the ripple to a much lower level than that of a one-transistor amplifier. Further, the conducting periods of the four transistors are equally spaced with a 90° phase shift between them, and thus the frequency of the ripple is four times the operating frequency of the circuit, which makes it much easier to filter out the ripple in other parts of the circuit.

BRIEF DESCRIPTION OF THE DRAWINGS

The invention will now be described more fully below with reference to the drawings, in which.

DETAILED DESCRIPTION OF EMBODIMENTS

Figure 1:
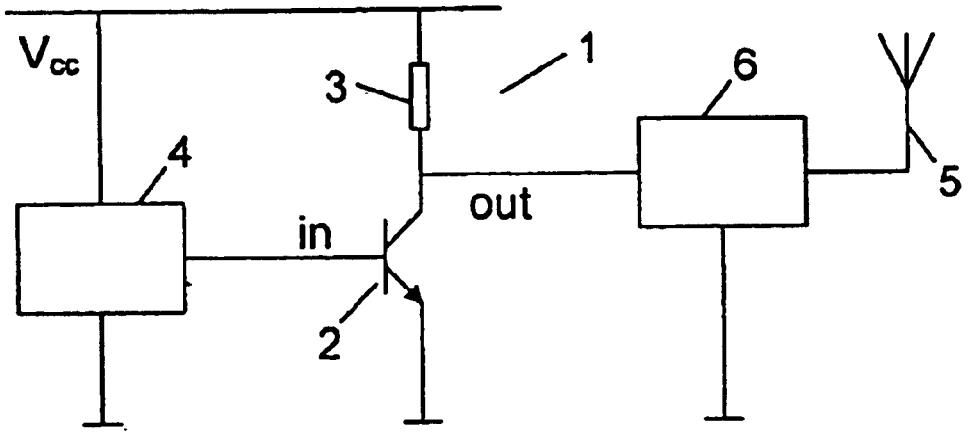
Fig. 1 PRIOR ART
FIG. 1 shows a known one-transistor power amplifier.

First some prior art circuits will be described for comparison with circuits according to the invention. Thus FIG. 1 shows a prior art power amplifier 1 of the one-transistor amplifier type for use in a portable radio communications device. Although the amplifier in a practical circuit will typically comprise several additional components, it is here illustrated as consisting of a transistor 2 and an impedance 3. The impedance 3 can be any type of impedance, e.g. a current generator having a very high impedance at radio frequencies. The input to the power amplifier 1 comes from a radio circuit 4, and the amplified output is delivered at the out-terminal. The output power from the amplifier is connected to an antenna 5, but because the antenna 5 will normally present an impedance mismatch to the output of the power amplifier 1, an isolator 6 is normally inserted between the output of the power amplifier 1 and the antenna 5 in order to improve the VSWR (Voltage Standing Wave Ratio) of the circuit.

Figure 2:
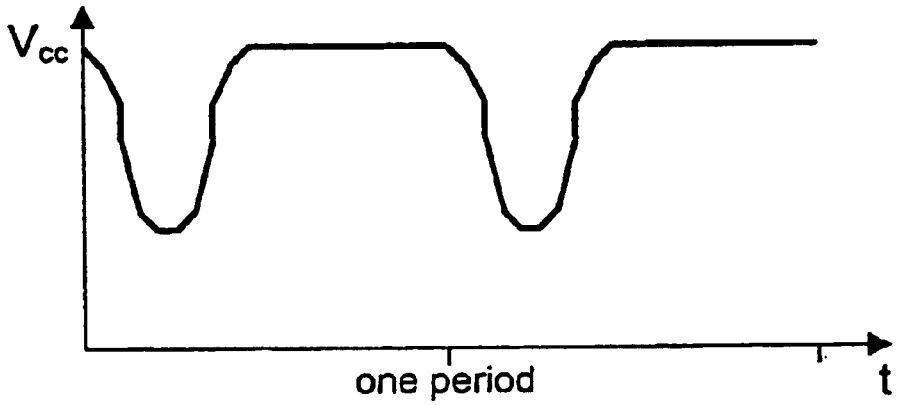
Fig. 2 PRIOR ART
FIG. 2 shows an example of ripple on the supply voltage to the amplifier of FIG. 1.

In a portable radio communications device, such as a mobile telephone, the power amplifier is generally driven so strongly that overloading occurs. This means that the transistor is driven in its non linear region, and ripple in the form of pulses will be generated in the current drawn from the supply voltage (Vcc) to the amplifier, and thus on the supply voltage itself. This is illustrated in FIG. 2 which shows that one pulse is generated for each period of the radio frequency signal amplified by the power amplifier. For e.g. a GSM mobile phone the frequency could typically be 900 MHz or 1800 MHz. The form of the pulse shown is just illustrative, and similarly, the amplitude is shown exaggerated for illustrative purposes.

The presence of this ripple on the supply voltage to the power amplifier prevents the power amplifier from being integrated on the same chip as the rest of the radio circuit 4, because this circuit contains some very sensitive components, and unacceptable distortion would be the result.

Figure 3:
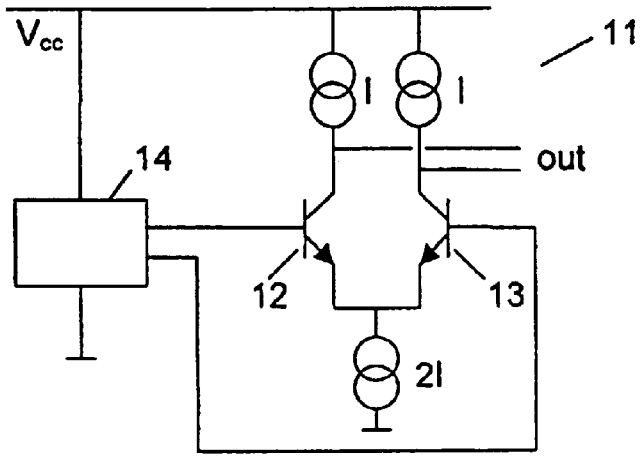
Fig. 3 PRIOR ART
FIG. 3 shows a known differential power amplifier.

The ripple can be reduced by combining multiple transistors, such that the current drawn from the supply voltage is divided between the multiple transistors, provided the transistors do not conduct simultaneously. One way is to use a differential amplifier 11 as shown in FIG. 3. The radio circuit 14 now delivers the signal to be amplified to the power amplifier 11 as a differential signal which is amplified by the two transistors 12 and 13. As long as such an amplifier is driven in its linear region the current through the transistors is close to being constant (2×I), but as mentioned above, this is not the case. The two transistors now conduct in anti-phase, and thus the pulses in the current drawn from the supply voltage, and thus in the supply voltage itself, are phase shifted 180° from each other. At the same time the amplitude of each pulse is halved, because the total current is divided between the two transistors.

Figure 4:
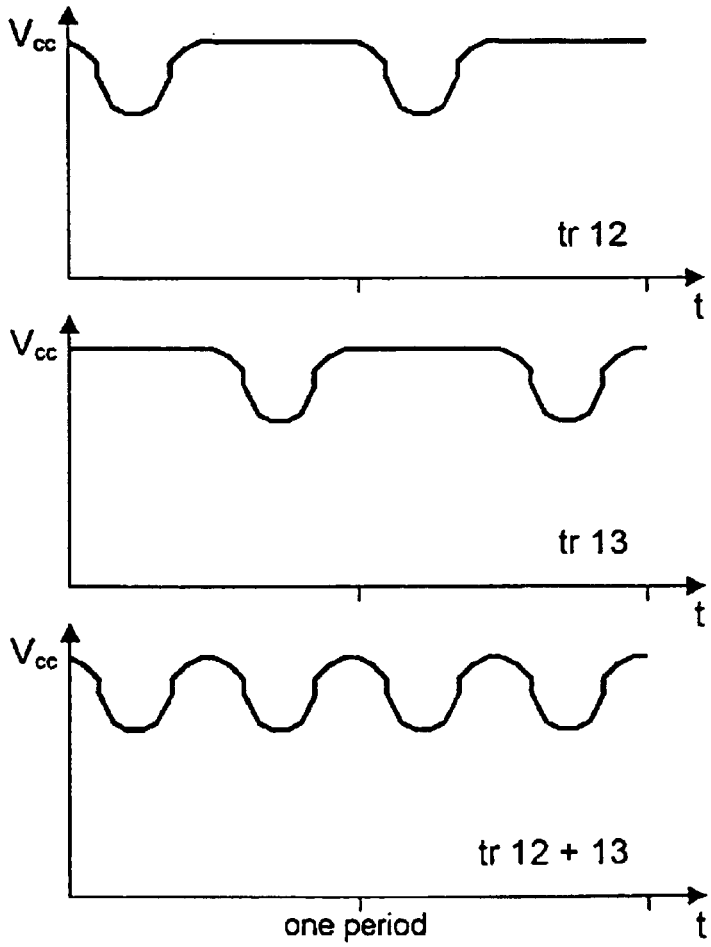
Fig. 4 PRIOR ART
FIG. 4 shows an example of ripple on the supply voltage to the amplifier of FIG. 3.

This is illustrated in FIG. 4. The upper diagram shows the ripple caused by transistor 12, while the next diagram similarly shows the ripple caused by transistor 13. Finally, the lower diagram shows the combined ripple. It will be seen that the frequency of the ripple is doubled and the amplitude halved, but still the ripple is significant and prevents the power amplifier from being integrated together with the rest of the radio circuit.

Figure 5:
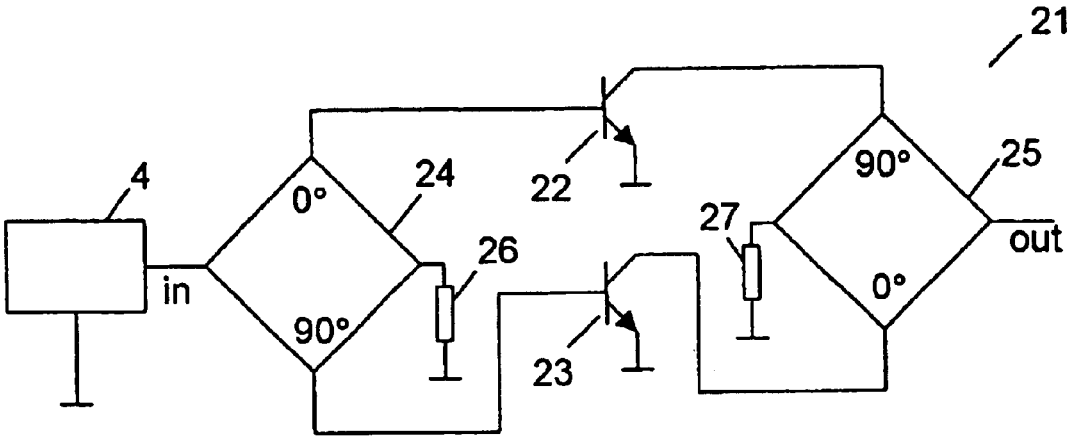
Fig. 5 PRIOR ART
FIG. 5 shows a known power amplifier with quadrature hybrid couplers.

The combination of multiple transistors can also be implemented in a power amplifier in which the transistors are connected together by means of an arrangement of hybrid couplers as illustrated with the power amplifier 21 in FIG. 5. The two transistors 22 and 23 are connected to the two hybrid couplers 24 and 25. For better understanding of this circuit, the function of a hybrid coupler will be briefly described below.

When circuits are implemented in e.g. microstrip or stripline technologies, an electrical leakage field extends a short distance outside the conductive pattern. This gives rise to capacitive coupling between two adjacent conductors. The coupling increases with decreasing separation of the conductors, and the strongest coupling is achieved when the two conductors are in close proximity for a distance of a quarter of a wavelength at the operating frequency. In addition, a strong directional effect is obtained.

Figure 6:
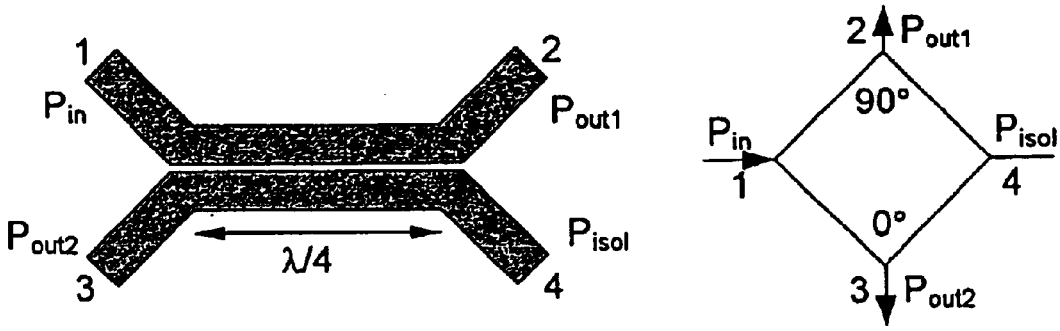
Fig. 6 PRIOR ART
FIG. 6 shows the structure of a direct-coupled line coupler.

As an example, a direct-coupled line coupler is shown in FIG. 6. If power is applied to the arrangement via port 1, a portion of the power is transferred to the other conductor. In case of ideal matching at all ports, all the power transferred to the other conductor will be fed out through port 3. No power is transferred to port 4, and therefore the coupler is called a directional coupler. Through adjustment of the distance between the conductors the proportion of power transferred to port 3 can be varied. If the losses in the line structure are disregarded, all the remaining input power will flow through port 2. In this case the so-called 3 dB coupler, in which the power is split equally between ports 2 and 3, is the most interesting one, but other variations are possible. An important characteristic of the shown hybrid coupler is the relative difference between the phases of the signals at ports 1, 2 and 3. In particular, it is noted that for this coupler the phase difference between the two output ports, i.e. ports 2 and 3, is 90°. Therefore, the coupler is called a quadrature hybrid.

Figure 7:
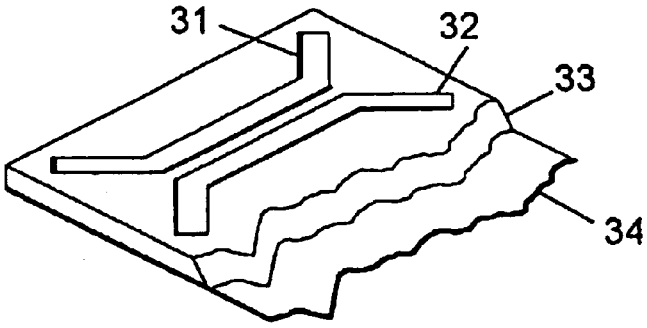
Fig. 7 PRIOR ART
FIG. 7 shows an implementation of a direct-coupled line coupler in a microstrip technology.

FIG. 7 shows how this coupler can be implemented in a microstrip technology. The conductors 31 and 32 are placed on one side of a substrate 33, while a ground plane 34 is located on the opposite side of the substrate 33. In a stripline technology the conductors of the coupler would be placed in the middle of a substrate having ground planes on both sides. In a practical solution it can be difficult to position the two conductors close enough to each other to obtain sufficient coupling. Therefore, a practical solution is often implemented as e.g. a Lange coupler, which is well known and therefore not described in further detail here. It can be noted that the coupler is symmetrical, such that if a signal is input to e.g. port 2 instead of port 1, port 3 will be the isolated port and the input power will be divided equally between ports 1 and 4, with the same relative phase positions.

Figure 8:
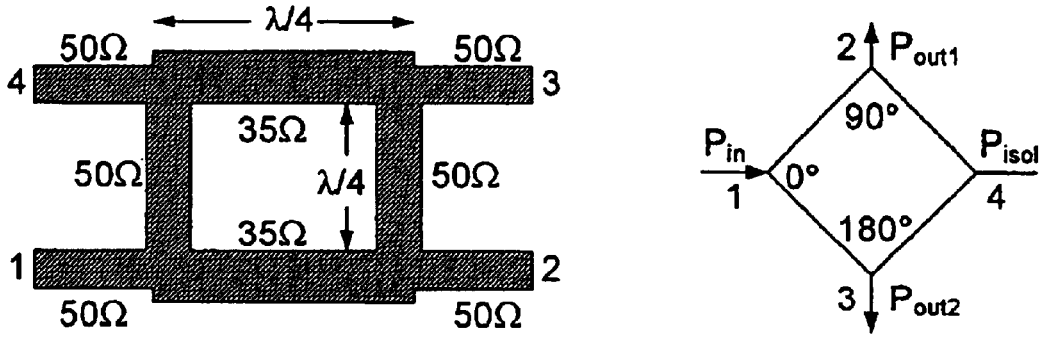
Fig. 8 PRIOR ART
FIG. 8 shows the structure of a line-coupled hybrid.

The coupling between two lines can also be effected by connecting lines. A simple version of a line-coupled hybrid is shown in FIG. 8. The best characteristics are obtained when the distance between the coupling lines as well as the length of the lines correspond to a quarter of a wavelength at the operating frequency. With 50 Ω coupling lines and 35 Ω characteristic impedance for the intervening line sections, both 3 dB coupling and a 50 Ω impedance of the ports are achieved. The characteristics of this type of hybrid are also shown in the figure. If a signal is applied to port 1, the power is split between ports 2 and 3 with the mutual phase difference being 90°. This hybrid is therefore also of the quadrature type.

Hybrids of the quadrature type as described above can be used in the circuit of FIG. 5. When the signal from the radio circuit 4 is coupled to the input port of the hybrid 24 there will be a 90° phase difference between the output ports, which corresponds to a $\lambda/4$ difference in the propagation path. Provided the connection lines from the output ports of the hybrid 24 to the input of the transistors 22 and 23 have equal electrical lengths, the inputs of the two transistors will also have a 90° phase difference, and thus the transistors will conduct with a 90° phase shift between each other. The outputs of the transistors 22 and 23 are connected to a hybrid 25 which is of the same type as the hybrid 24. Provided again that the connection lines from the transistors to the hybrid 25 are of equal electrical lengths, the two input signals to the hybrid 25 will also have a 90° phase difference. The hybrid is symmetrical, and thus it will now function with two input ports to which the two input signals with a 90° phase difference are connected, and these signals will be combined to one signal at the single output port while the fourth port is still isolated. The total electrical length of the two paths through the transistors should be the same from the input of the input hybrid to the output of the output hybrid. In this way the two waves are added optimally in phase in the output hybrid.

In order to minimize the effect of mismatch in the transistor inputs, the electrical lengths from the input of the input hybrid to the input of the two transistors should differ by $\lambda/4$, because then reflected waves from the transistors will cancel each other in the input hybrid. This difference is obtained in the quadrature hybrid. As mentioned above, this means that the transistors will conduct with a 90° phase difference between each other. Therefore the pulses in the current drawn from the supply voltage, and thus in the supply voltage itself, will also be phase shifted 90° from each other. Similarly to the circuit of FIG. 3 the amplitude of each pulse is halved compared to the one-transistor solution, because the total current is divided between the two transistors.

Figure 9:
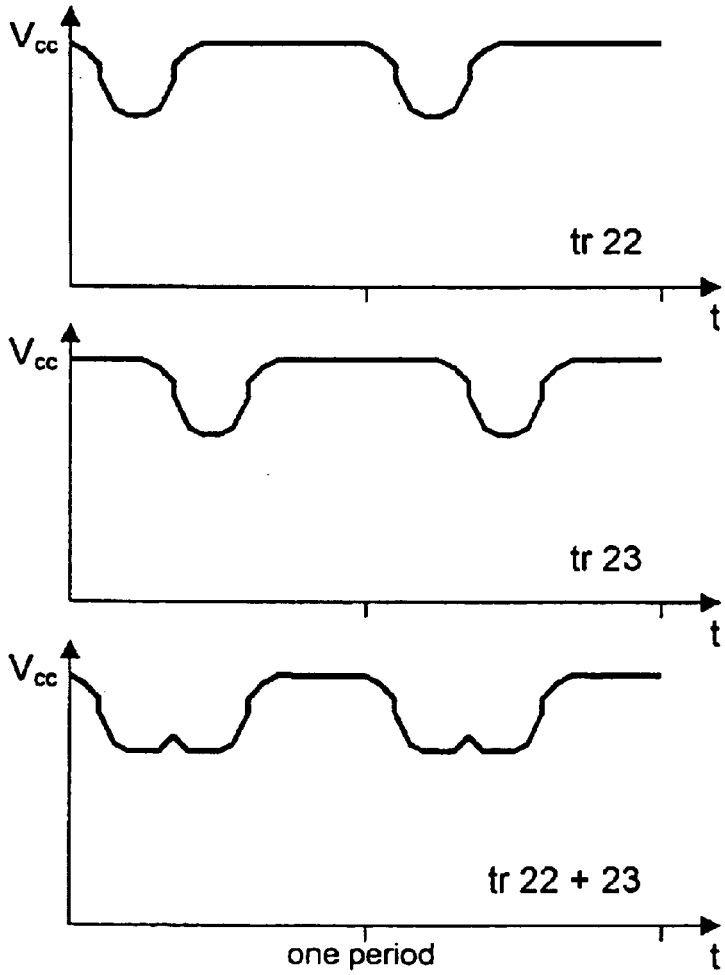
Fig. 9 PRIOR ART
FIG. 9 shows an example of ripple on the supply voltage to a power amplifier with hybrid couplers.

This is illustrated in FIG. 9. The upper diagram shows the ripple caused by transistor 22, while the next diagram similarly shows the ripple caused by transistor 23. Finally, the lower diagram shows the combined ripple. It will be seen that in this case the frequency of the ripple will still have a component of the operating frequency, and there will also be a component of twice the operating frequency. Again, the amplitude is halved, but still the ripple is significant and prevents the power amplifier from being integrated together with the rest of the radio circuit.

Figure 10:
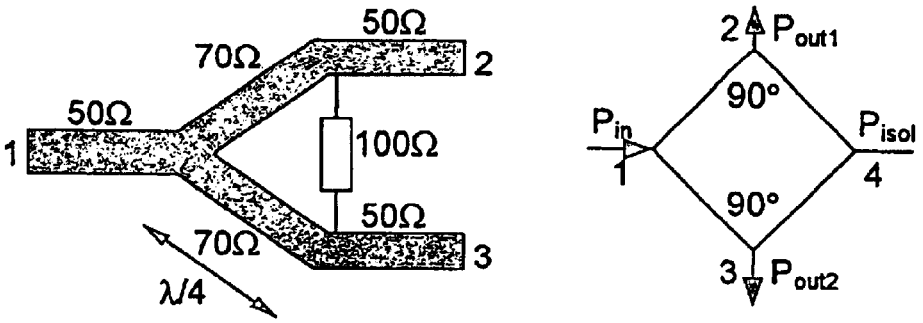
Fig. 10 PRIOR ART
FIG. 10 shows the structure of a Wilkinson hybrid.

The hybrids described above are of the quadrature type. However, in some applications other types are preferred, and thus the design principles of two other hybrid types, in which the two output signals are in phase, will be described. FIG. 10 shows a Wilkinson hybrid which basically consists of a forked line. To obtain a coupling impedance of 50 Ω in port 1, the 50 Ω lines in ports 2 and 3 are transformed to 100 Ω at the fork by means of a quarter-wave 70 Ω impedance transformer. On matching of both port 2 and port 3, identical voltages are obtained on both sides of the 100 Ω resistance. Thus, no power is lost in the resistance, which can be seen as an internal isolated port.

Figure 11:
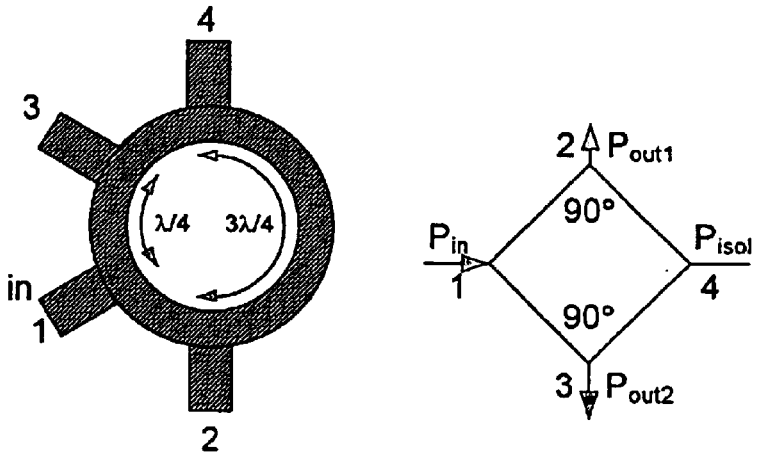
Fig. 11 PRIOR ART
FIG. 11 shows the structure of a circular hybrid.

Another hybrid, which can produce output signals in phase, is the circular hybrid shown in FIG. 11. If a signal is applied to port 1, two waves result which travel in opposite directions round the circular line. The circumference ($3/2\lambda$) of the circular line and the relative positions of the ports have been chosen such that the two waves will be added in phase or in anti-phase at the points where the ports are connected. If the signals are added in anti-phase, no output signal will result. This corresponds to the isolated port.

Figure 12:
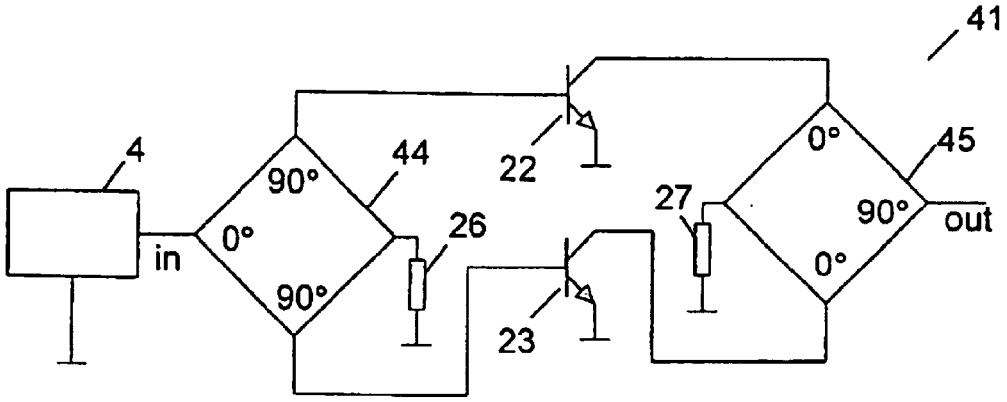
Fig. 12 PRIOR ART
FIG. 12 shows a known power amplifier with in-phase hybrid couplers.

These hybrid couplers can be used in an amplifier circuit similar to that of FIG. 5, and a modified version of the circuit is shown in FIG. 12. The amplifier 41 differs from the amplifier 21 in FIG. 5 in that hybrids 44 and 45 having in-phase ports are used instead of the quadrature hybrids 24 and 25. These hybrids have the same electrical length from the input port to the two output ports, or, in the opposite direction, to two input ports to a common output port. In order to maintain a 90° phase difference between the transistors, the connection lines from the output ports of the hybrid 44 to the inputs of the transistors 22 and 23 are arranged to have a $\lambda/4$ difference in their electrical lengths. Similarly, the connection lines from the transistor outputs to the input ports of the output hybrid 45 have a $\lambda/4$ difference in electrical length in order to ensure that the inputs to the hybrid 45 are in phase. Thus again, the total electrical length of the two paths through the transistors is the same from the input of the input hybrid to the output of the output hybrid, and the two waves are added optimally in phase in the output hybrid. The ripple of this solution is the same as the one shown in FIG. 9, and thus the amplifier is not suitable for integration together with the rest of the radio circuit.

Figure 13:
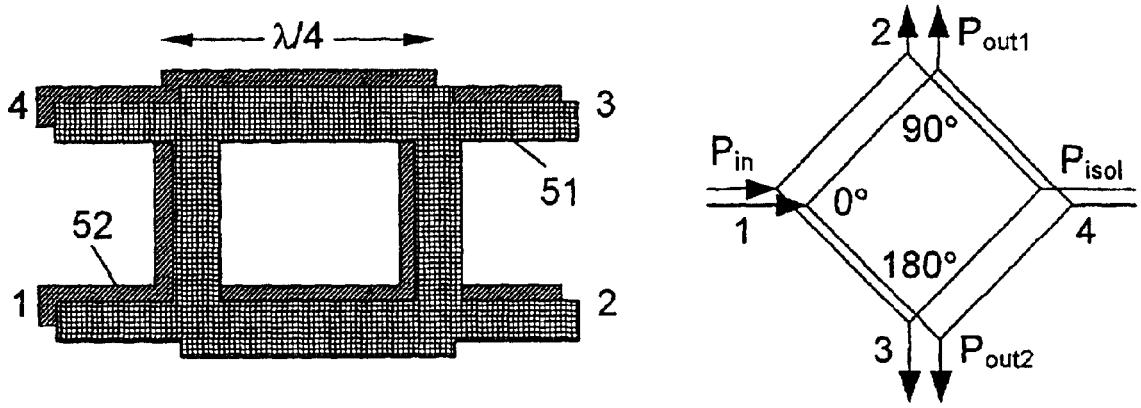
FIG. 13 shows the structure of a differential line-coupled hybrid according to the invention.

This problem is solved by the invention. The idea is to implement a hybrid coupler as a differential hybrid, as will now be described. FIG. 13 shows an example of a differential hybrid coupler of the line-coupled type. the structure is similar to that of FIG. 8, but instead of using the ground plane as a reference plane, two identical structures 51 and 52, both similar to the one known from FIG. 8, are implemented above each other in separate layers. Each of the differential lines in the structure has the same impedance and the same length as the single ended hybrid of FIG. 8. A differential signal applied to the two ports labelled "1" will be divided between the differential ports 2 and 3 with the mutual phase difference being 90°. Thus this hybrid is a differential quadrature hybrid. No signal will be present at the differential port 4, and thus again this port is an isolated port. The isolated port can be terminated with a resistor to ensure impedance matching, but, as mentioned, no signal will be present across such resistor.

Figure 14:
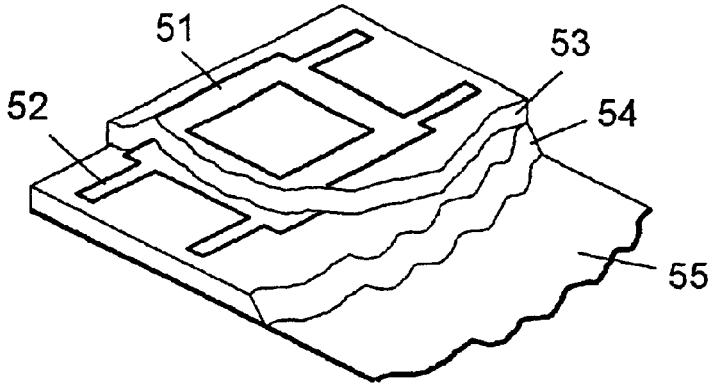
FIG. 14 shows an implementation of a differential line-coupled hybrid in a microstrip technology.

FIG. 14 shows how this differential line-coupled hybrid can be implemented in a microstrip technology. Two substrate layers 53 and 54 are used. The conducting pattern 51 is placed on the top side of the substrate layer 53, while the pattern 52 is placed between the two substrate layers in line with the pattern 51. Like before, a ground plane 55 is located at the opposite side of the substrate 54. The figure does not show the connections to the structure, but these are easily implemented, as is well known in the microstrip technology.

Figure 15:
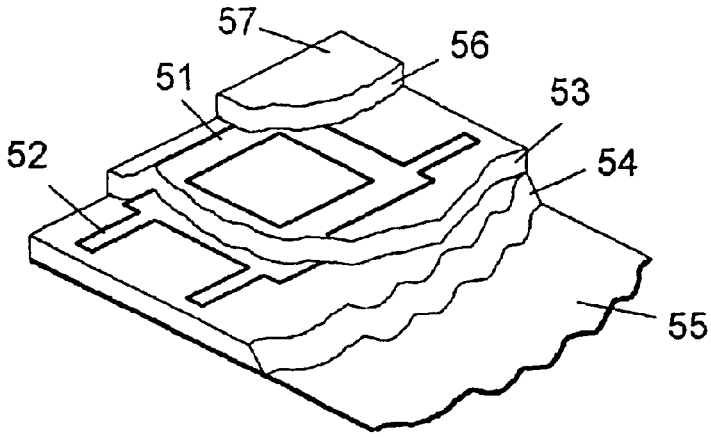
FIG. 15 shows an implementation of a differential line-coupled hybrid in a stripline technology.

Alternatively, the structure can also be implemented in a stripline technology as shown in FIG. 15. The structure is very similar to the microstrip structure, but a further substrate layer 56 is added at the top of the layer 53, such that also the conducting pattern 51 will be placed between two substrate layers. A second ground plane 57 is located at the top of the layer 56, so that the conducting patterns are placed between two ground planes, as is well known in the stripline technology.

Above, a differential hybrid of the line-coupled type is described, but it should be noted that any of the other hybrid types illustrated in e.g. FIGS. 6, 10 and 11 can easily be implemented as differential hybrids as well. This is also the case for other hybrid types not specifically described in this document.

Figure 16:
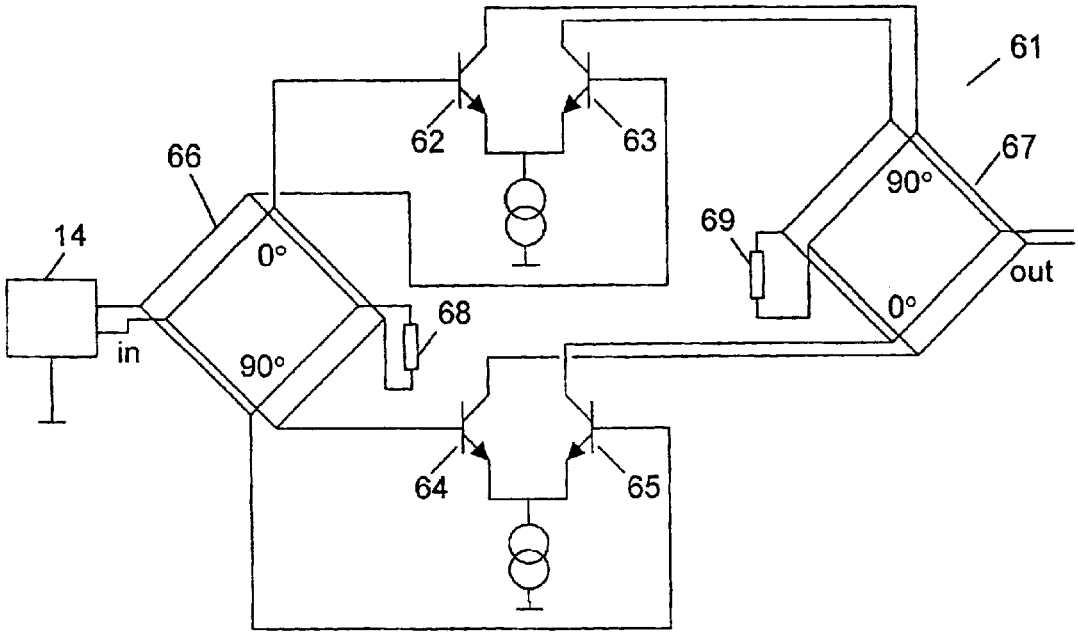
FIG. 16 shows a first embodiment of a power amplifier with a differential hybrid coupler according to the invention.

A power amplifier circuit utilizing the differential hybrid couplers is shown in FIG. 16. When the differential signal from the radio circuit 14 is coupled to the differential input port of the hybrid 66 there will be a 90° phase difference between the output ports, which corresponds to a $\lambda/4$ difference in the propagation path. One of the differential output ports is connected to the two transistors 62 and 63 which conducts in anti-phase because of the differential signal, provided the connection lines have equal electrical lengths. The other differential output port, which has a 90° phase difference from the first one, is connected to the transistors 64 and 65. These transistors also conduct in anti-phase. Since each transistor pair conducts in anti-phase, and there is a 90° phase difference between the two pairs, the conduction periods for the four transistors are now distributed equally with a 90° phase difference between each period.

The outputs of the transistors 62 and 63 are connected to one differential input port of the differential hybrid 67 which is of the same type as the hybrid 66. Similarly, the outputs of the transistors 64 and 65 are connected to the other differential input port of the differential hybrid 67. Provided again that the connection lines from the transistors to the hybrid 67 are of equal electrical lengths, the two differential input signals to the hybrid 67 will also have a 90° phase difference. Also the differential hybrid is symmetrical, and thus it will now function with two differential input ports to which the two differential input signals with a 90° phase difference are connected, and these signals will be combined to one differential signal at the differential output port while the fourth port is still isolated. Again the total electrical length of the paths through the transistors should be the same from the input of the input hybrid to the output of the output hybrid. In this way the waves are added optimally in phase in the output hybrid. The isolated ports of the two hybrids are terminated with the resistors 68 and 69.

Figure 17:
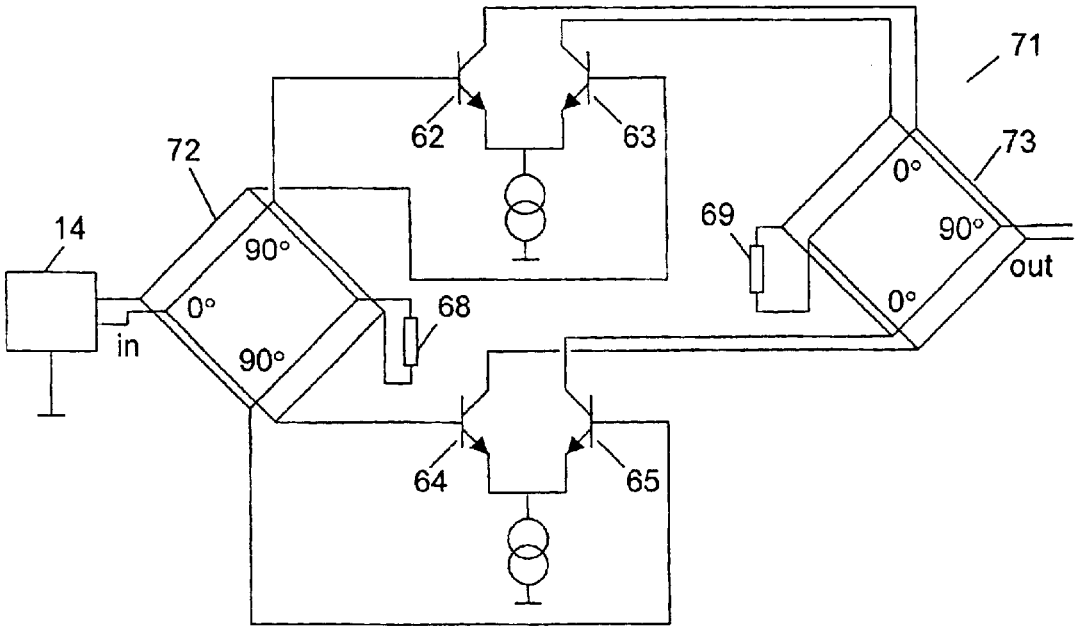
FIG. 17 shows a second embodiment of a power amplifier with a differential hybrid coupler according to the invention.

The circuit of FIG. 16 uses differential quadrature hybrids, but again also in-phase hybrids can be used, as is shown in the circuit 71 in FIG. 17. The only differences from FIG. 16 are that in-phase hybrids 72 and 73 are used instead of the quadrature hybrids, and that the electrical lengths of the connections between the transistors and the hybrids in the upper part of the circuit differ with $\lambda/4$ from the connections in the lower part of the circuit to ensure that the transistors 62 and 63 still have a 90° phase difference from the transistors 64 and 65.

As mentioned above, the four transistors in FIG. 16 or FIG. 17 will conduct with a 90° phase difference between each other. Therefore the pulses in the current drawn from the supply voltage, and thus in the supply voltage itself, will also differ 90° from each other. The amplitude of each pulse is now reduced to one quarter compared to the one-transistor solution, because the total current is divided between the four transistors.

Figure 18:
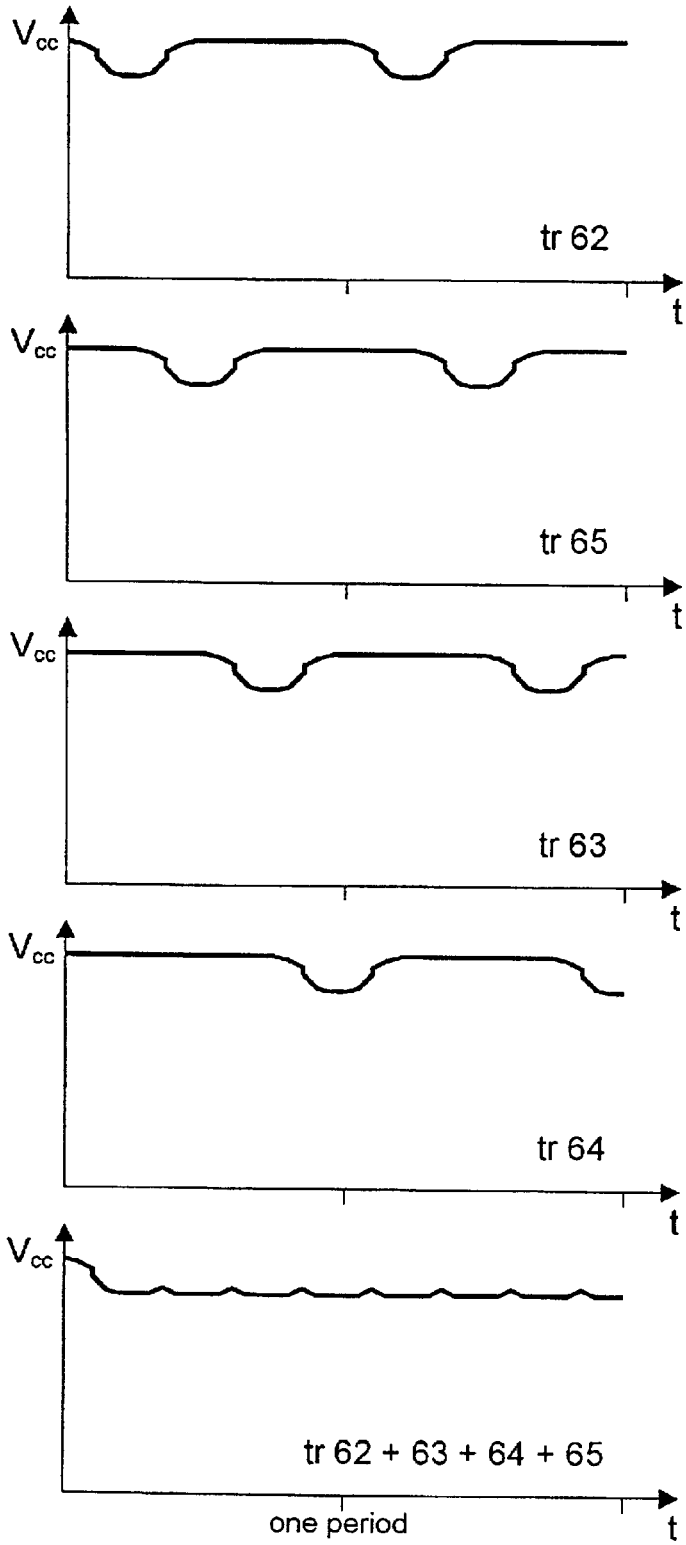
FIG. 18 shows an example of ripple on the supply voltage to a power amplifier according to the invention.

This is illustrated in FIG. 18. The upper diagram shows the ripple caused by transistor 62, while the next diagrams similarly show the ripple caused by transistors 65, 63 and 64. Finally, the lower diagram shows the combined ripple. It is seen that the ripple now has a frequency four times the operating frequency, and that the amplitude is now much reduced. As mentioned before, the shown shape of the ripple is only illustrative, but even with other shapes the ripple will at least be reduced to a quarter of the ripple for the one-transistor solution. Further, four times the operating frequency is far easier to filter out in other blocks. This means that with this solution it is possible to integrate the power amplifier with the transistors and the hybrids together with the more sensitive functions of the radio circuit on one chip or very close in the same package.

As mentioned for the single ended hybrid amplifier, the output hybrid will make the load of the collectors of the transistors unsensitive to load mismatch at the output, or at least the circuit can be compensated therefor by a feed-back coupling. This also applies to the differential hybrid amplifier, although the load is of course differential. Thus this solution also allows that the output can be connected directly to the antenna without the need for an isolator between the amplifier and the antenna.

The solution also allows for lower voltage operation. This is due to the fact that the peak current is now divided between four transistors. Further, because the transistor stages are differential they can in practice work with twice the actual supply voltage even without inductive chokes at the supply lines. If chokes are used, it could be up to four times the actual supply voltage. Thus it is possible to operate the power amplifier with very low supply voltages, which is often a demand in e.g. mobile telephones.

Although a preferred embodiment of the present invention has been described and shown, the invention is not restricted to it, but may also be embodied in other ways within the scope of the subject-matter defined in the following claims.

What is claimed is:

1. A hybrid coupler comprising:

four differential ports; and wherein the hybrid coupler is arranged to couple differential radio frequency signals having a certain frequency from at least one differential port to at least one other differential port.

2. A hybrid coupler according to claim 1, wherein the hybrid coupler is implemented in a stripline technology.

3. A hybrid coupler according to claim 1, wherein the hybrid coupler is implemented in a microstrip technology.

4. A hybrid coupler according to claim 1, wherein it is a 3 dB coupler, such that power of said frequency supplied to one port is split substantially equally between two other ports, while the remaining port is substantially isolated from the other ports.

5. A hybrid coupler according to claim 4, wherein it is arranged to split the power between the two other ports in such a way that the signals provided at these ports are in phase with each other.

6. A hybrid coupler according to claim 4, wherein it is arranged to split the power between the two other ports in such a way that the signals provided at these ports are in quadrature to each other.

7. A hybrid coupler according to claim 6, wherein it is a line-coupled hybrid.

8. An amplifying circuit for radio frequency signals having a certain frequency and thus a certain wavelength, said circuit comprising at least:

a first hybrid coupler having
- an input port to which radio frequency signals can be applied;
- an isolated port;
  - a first output port; and
  - a second output port;
  - and being arranged for dividing a signal applied to the input port into a first signal component to the first output port and a second signal component to the second output port; p2 a first amplifier having an input port and an output port, said input port being connected to the first output port of the first hybrid coupler;
- a second amplifier having an input port and an output port, said input port being connected to the second output port of the first hybrid coupler; and a second hybrid coupler having
- a first input port connected to the output port of the first amplifier;
- a second input port connected to the output port of the second amplifier;
- an isolated port; and
  - an output port connectable to an output load impedance; and
  - being arranged for combining signals applied to the first input port and the second input port to the output port;

said first and second hybrid couplers and said first and second amplifiers providing a first and a second path for radio frequency signals from the input port of the first hybrid coupler to the output port of the second hybrid coupler, said first path comprising the first amplifier and said second path comprising the second amplifier, and wherein the total electrical lengths of the two paths are substantially identical, and the electrical length from the input port of the first hybrid coupler to each of the input ports of the first and second amplifiers differs by a quarter of a wavelength for said radio frequency signals, wherein said hybrid couplers are implemented as differential couplers arranged to couple differential radio frequency signals, and said amplifiers are differential amplifiers.

9. An amplifying circuit according to claim 8, wherein said first and second hybrid couplers are implemented in a stripline technology.

10. An amplifying circuit according to claim 8, wherein said first and second hybrid couplers are implemented in a microstrip technology.

11. An amplifying circuit according to claim 8, wherein said first and second hybrid couplers are 3 dB couplers.

12. An amplifying circuit according to claim 11, wherein said first and second hybrid couplers are in-phase couplers, such that said first and second signal components on the output ports of the first hybrid coupler are in phase with each other, and signals in phase with each other applied to the two input ports of the second hybrid coupler are combined to one signal at its output port.

13. An amplifying circuit according to claim 11, wherein said first and second hybrid couplers are quadrature couplers, such that said first and second signal components on the output ports of the first hybrid coupler are in quadrature to each other, and signals in quadrature to each other applied to the two input ports of the second hybrid coupler are combined to one signal at its output port.

14. An amplifying circuit according to claim 13, wherein said first and second hybrid couplers are line-coupled hybrids.

15. A portable radio communications device comprising an amplifying circuit according to claim 8.

16. A portable radio communications device according to claim 15, wherein the device is a mobile telephone.

17. A method of amplifying radio frequency signals having a certain frequency and thus a certain wavelength, said method comprising the steps of:

applying radio frequency signals to an input port of a first hybrid coupler;

dividing the signals applied to the input port into a first signal component to a first output port of the first hybrid coupler and a second signal component to a second output port of the first hybrid coupler;

amplifying said first signal component in a first amplifier having an input port and an output port, said input port being connected to the first output port of the first hybrid coupler;

amplifying said second signal component in a second amplifier having an input port and an output port, said input port being connected to the second output port of the first hybrid coupler;

coupling the amplified first signal component from the output port of the first amplifier to a first input port of a second hybrid coupler and the amplified second signal component from the output port of the second amplifier to a first input port of the second hybrid coupler;

combining in the second hybrid coupler the signals applied to the input ports thereof to an output signal on the output port of the second hybrid coupler; and coupling said output signal to an output load impedance, wherein the total electrical lengths of the paths of the two signal components from the input port of the first hybrid coupler to the output port of the second hybrid coupler are substantially identical, and the electrical length from the input port of the first hybrid coupler to each of the input ports of the first and second amplifiers differs by a quarter of a wavelength for said radio frequency signals, wherein the radio frequency signals are applied, coupled and amplified as differential signals from the input port of the first hybrid coupler to the output port of the second hybrid coupler.

* * * * *